US005150640A

United States Patent [19]

Schnitzer

[11] Patent Number: 5,150,640

[45] Date of Patent: Sep. 29, 1992

[54] HIGH-SPEED CUTTER FOR YARNS

[75] Inventor: Tadeusz E. Schnitzer, Wilmington, Del.

[73] Assignee: E. I. du Pont de Nemours and Company, Wilmington, Del.

[21] Appl. No.: 689,586

[22] Filed: Apr. 23, 1991

Related U.S. Application Data

[63] Continuation-in-part of Ser. No. 461,470, Dec. 28, 1989, Pat. No. 5,033,345.

[51] Int. Cl.[5] ..... B26D 1/08

[52] U.S. Cl. ..... 83/583; 83/588; 83/639.1; 83/950

[58] Field of Search ..... 83/949, 950, 582, 639.1, 83/585, 578, 571, 196, 198, 588, 583

[56] References Cited

U.S. PATENT DOCUMENTS

| | | | |
|---|---|---|---|
| 3,469,750 | 9/1969 | Vanderbeck | 83/198 X |
| 3,624,720 | 11/1971 | Lakey | 83/198 |
| 3,760,674 | 9/1973 | Temple et al. | 83/370 |
| 3,854,356 | 12/1974 | Okreglak | 83/66 |
| 3,972,116 | 8/1976 | Forsythe et al. | 83/198 X |
| 4,023,741 | 5/1977 | Schar | 242/18 R |
| 4,052,017 | 10/1977 | Schar | 242/355 A |
| 4,108,388 | 8/1978 | Schar | 242/18 DD |
| 4,157,048 | 6/1979 | Lemmer | 83/582 X |
| 4,496,109 | 1/1985 | Cardell | 242/18 R |
| 4,789,277 | 12/1988 | Rhodes et al. | 83/13 X |
| 4,872,381 | 10/1989 | Stroms | 83/76.1 |
| 5,033,345 | 7/1991 | Schnitzer | 83/366 |

OTHER PUBLICATIONS

Machine and Tool Blue Book, Oct. 1988, pp. 56–59, Mel Vogle & Al Gates.

Aremco Products, Inc., Materials Catalog M12.

*Primary Examiner*—Douglas D. Watts

*Assistant Examiner*—Kenneth E. Peterson

[57] ABSTRACT

A yarn cutting apparatus comprising a cutter body, cutting means, and rigid stop means, wherein a line-to-surface contact is created between the cutting elements for cutting the yarn. The cutting means includes a slotted cutting element affixed to either the cutter body or a piston.

12 Claims, 12 Drawing Sheets

HIGH-SPEED CUTTER FOR YARNS

This application is a continuation-in-part of U.S. patent application Ser. No. 07/461,470, filed Dec. 28, 1989, now U.S. Pat. No. 5,033,345.

BACKGROUND OF THE INVENTION

Conventional cutting and winding operations for yarn include a doffing/donning operation often performed manually. Typically an operator severs the yarn with scissors while the inlet of a suction or aspirator gun is held against the yarn at a point above the point of severing. Once the yarn is severed, the tail end is wound onto a yarn package while the newly formed leading end is sucked into the aspirator and fed to a waste collector. The suction gun is then placed onto a holder while the yarn package is replaced with an empty tube core. When the empty tube core attains full speed, the operator manipulates the suction gun to attach the yarn to the rotating empty tube core and then severs the yarn again by cutting or tension breaking at the suction gun so that the winding operation may continue. All the yarn going to the suction gun during the transfer time is going to waste.

In order to economize these winding operations, mechanisms which automatically sever, aspirate and rethread the yarn have been developed. U.S. Pat. No. 4,496,109, issued on the application of Cardell, discloses such an auto transfer system where a signal furnished to the machine allows pressurized fluid to be supplied to a hydraulic cylinder. The hydraulic cylinder positions a cutter and yarn aspirator so that yarn enters the cutting slot of a stationary blade adjacent the aspirator. Air is then directed by a cam actuated valve causing pressure to build up in the working compartment of a cutter sleeve. When the pressure eventually overcomes the restraint imposed by a spring ball detent, a reciprocable blade moves forward in a line to surface contact with the stationary blade thereby severing the yarn, the new leading end of which is aspirated to waste. The yarns are then threaded onto new cores, snagged by pinch grooves on the cores, and are broken as the yarn is placed in tension between the aspirator and rotating pinch grooves.

More efficient winders for aramid fibers require auto sever, no waste, transfer devices to sever and transfer the yarn from a full package to an empty tube core rapidly without aspirating any yarn to waste. This invention relates to a no waste transfer system in which a suction gun is not used to capture and transfer the yarn, but rather the yarn is snagged on an empty tube core and instantaneously severed from the full core without wasting any yarn in the process. With some yarns, the tension build-up during snagging is sufficient to break the yarn and accomplish the severing. However, for aramid fibers of moderate denier, the yarn is exceptionally strong and does not break except at high force levels. Therefore, an automatic cutting device which is actuated by the tension build-up in the yarn is needed. The cutting device must be very reliable, since if a cut is not completed, the force necessary to break the yarn of higher denier is high enough to damage the winder. An automatic cutting device must also be extremely fast acting so that yarn is cut quickly at the instant of snagging, since aramid yarn has very little elongation under load and the forces build up rapidly. In addition, an automatic cutting device should handle yarns with a wide variety of deniers, since it is most economical to use one cutter for a wide variety of products.

SUMMARY OF THE INVENTION

The present invention involves a yarn cutting apparatus with a cutting mechanism having a cutter body, actuator means, cutting means and valve means.

The cutter body has a bore with a slot extending transversely from the side of the body through the bore to a slot bottom, wherein the slot is adapted to receive a yarn which can be cut.

The actuator means is pivotably affixed to the cutter body and adjacent to the bottom of the slot. The actuator means includes a yarn contact surface on an actuator arm which is located at one end of the cutter body and a valve shifting means at the other end of the cutter body. The actuator means pivots upon force exerted on its surface by contact with the yarn.

The cutting means which cuts the yarn received in the slot as the actuator means pivots, includes a stationary cutting element affixed to the cutter body adjacent one side of the bore at the side of the slot opposite a first end of the bore and forming at least one edge of the slot, a piston slideably fitted into the bore and adapted to move from the first end of the bore toward the slot as a result of a valve means directing the pressurized fluid to the first end of the bore, a moveable cutting element affixed to the piston and adapted to pass by the stationary cutting element as the piston moves toward the slot, a biasing means to urge the moveable and stationary cutting elements, one against the other, thereby cutting the yarn received in the slot as the moveable cutting element passes by the stationary cutting element, and a spring biasing means to urge the piston against the first end of the bore.

The valve means is attached to the cutter body adjacent a first end of the bore and adapted to be controlled by a valve shifting means. The valve means directs the cutting means toward the yarn to be cut and includes the valve shifting means, a shiftable element, a valve body, and ports for selectively directing pressurized fluid from a source to the first end of the bore and from the bore to the atmosphere allowing the piston to slide toward the stationary cutting element against the urging of the spring biasing means.

In an alternative way to view the cutter of this invention, the cutter body can be considered to include the cutter body itself, and the cutting means.

In operation, the tensioned yarn passes over the yarn contact surface on the actuator arm and through the cutting slot in the cutter body. At a predetermined tension, the yarn causes the actuator means to pivot and raises the valve shifting means allowing the valve means to direct pressurized air to force the piston which has an attached moveable cutting element to slide across the stationary cutting element which is affixed to the cutter body. The moveable cutting element and the stationary cutting element are urged, one against the other, by a biasing means; preferably by an appropriately positioned pair of elastomeric O rings. As the cutting edge of the moveable cutting element slides across and makes line to surface contact with the cutting edge of the stationary cutting element, the tensioned yarn is cut. The piston with the attached moveable cutting element may be prevented from rotating in a cylinder bore by an anti-rotational pin. The actuator arm may have a sharp angled edge on the yarn contact surface which can serve as a secondary cutter.

The present invention also includes a yarn cutter comprising a cutter body, a cutting means, and a rigid stop means. The cutter body contains a bore therethrough with a body slot extending transversely from one side of the body through the bore to a slot bottom. The body slot is adapted to receive a yarn.

In one embodiment, the means for cutting the yarn comprises a slotted piston, wherein the slot extends transversely from one side of the piston to a slot bottom which is aligned with the body slot, a slotted cutting element affixed to the cutter body having a planar surface which is continuously parallel to the longitudinal axis of the bore, and a cutting element affixed to the piston and having a straight line cutting edge. This relationship creates a "line-to-surface contact" between cutting elements throughout the piston travel from the first end to the second end of the bore. In another embodiment, the cutting means comprises the slotted piston, a slotted cutting element affixed to the piston having a planar surface which is continuously parallel to the longitudinal axis of the bore, and a cutting element affixed to the cutter body having a straight line cutting edge.

The rigid stop means continuously engages a surface on the cutter body and a surface on the piston throughout the piston travel, thereby preventing rotation of the piston.

The yarn cutter may further comprise a means for directing a source of pressurized fluid from a source to the first end of the bore and alternately directing the fluid from the source to the second end of the bore, or a spring biasing means for urging the piston against the force of the pressurized fluid. The yarn cutter may further comprise a resilient biasing means, such as an elastomeric pair of "O-rings" for urging the straight line cutting edge against the planar surface of the slotted cutting element. The yarn cutter may also have the support for each cutting element spaced away from the planar surface of the slotted cutting element such that a "pinching moment" about each support is created. The cutting elements may be made from alumina ceramic and/or tungsten carbide which may be coated with titanium carbide and titanium nitride.

DETAILED DESCRIPTION OF THE INVENTION

Figure 1A:
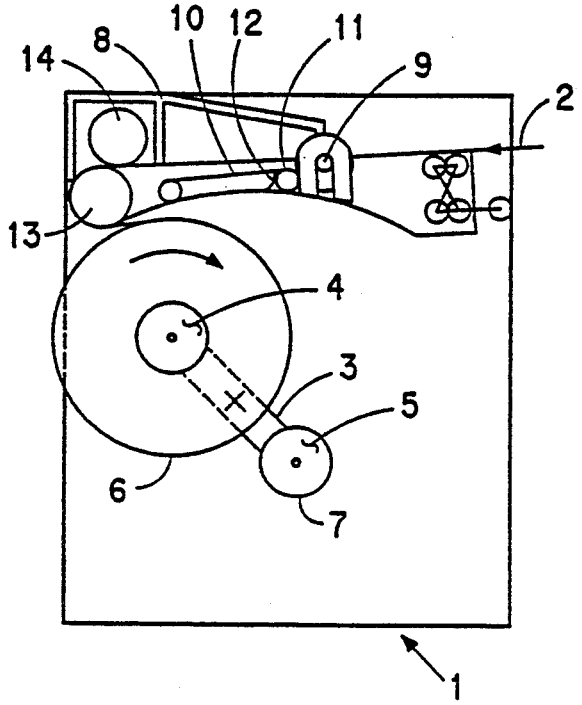
FIGS. 1A–H are side elevational views of a winder for yarn shown at different positions in a cycle for accomplishing no waste auto cutting and transferring of the yarn.

FIGS. 1A–1H show a diagram of a winder 1 for yarn, with the winder shown at different positions in a cycle for accomplishing no waste auto transfer of the yarn 2. It features a turret 3 on which are mounted two powered chucks 4 and 5, each chuck holding two packages of yarn such as full packages 6 or empty tube cores 7, one next to another. Mounted on a moveable frame member 8, pivotable about support 9, are two pivot arms 10, on the ends 11 of which are located cutters 12 of this invention. During winding pivot arms 10 are out of the way of the yarn packages as shown and full packages 6 are adjacent to but spaced from bale roll 13 which is adjacent to and spaced from a traverse means 14 shown in FIG. 1A. Traverse means 14 reciprocates the winding yarn along the longitudinal axis of the packages to ensure even distribution of the yarn on the package. Referring to FIG. 1J, although there are shown two yarns **2*a* and 2*b*, two packages 6*a* and 6*b*, and two cutters 12*a* and 12*b***, for simplicity of explanation, only one winder system will be referred to in the following discussion of FIG. 1.

Figure 1B:
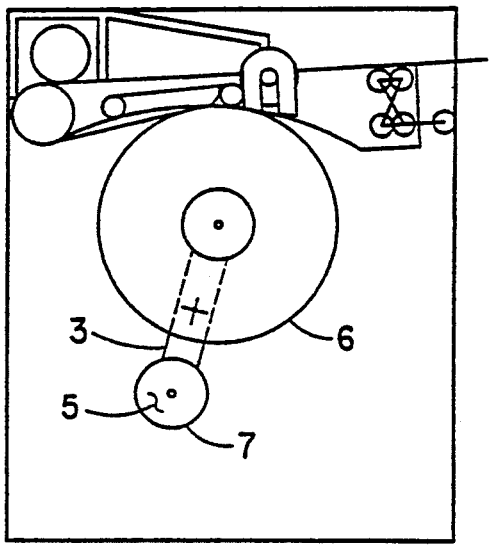
Figure 1C:
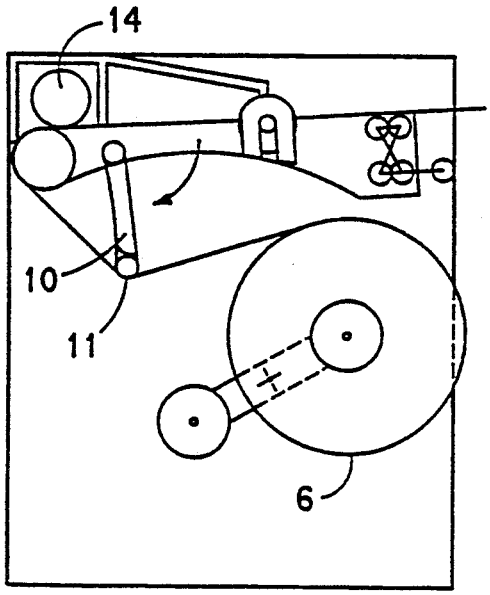
Figure 1D:
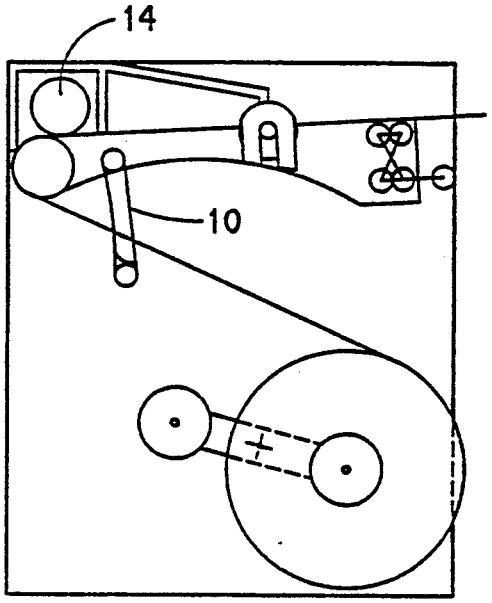
Figure 1E:
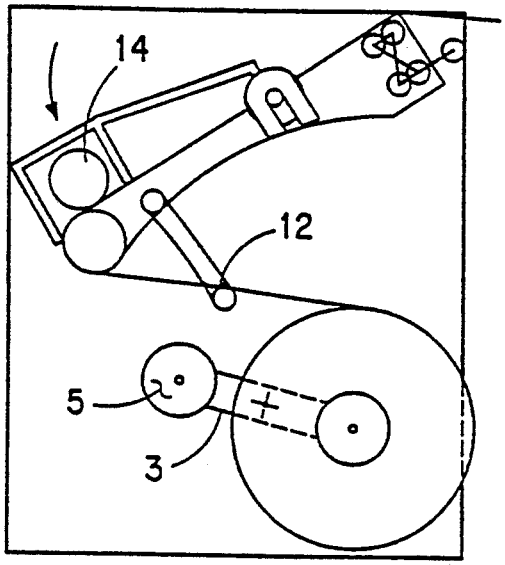
Figure 1F:
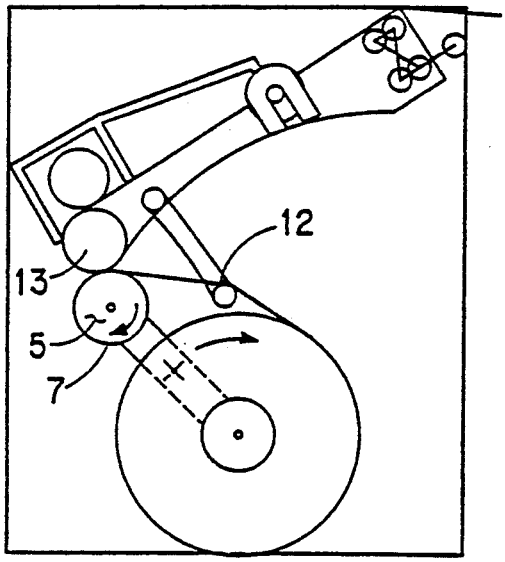
Figure 1G:
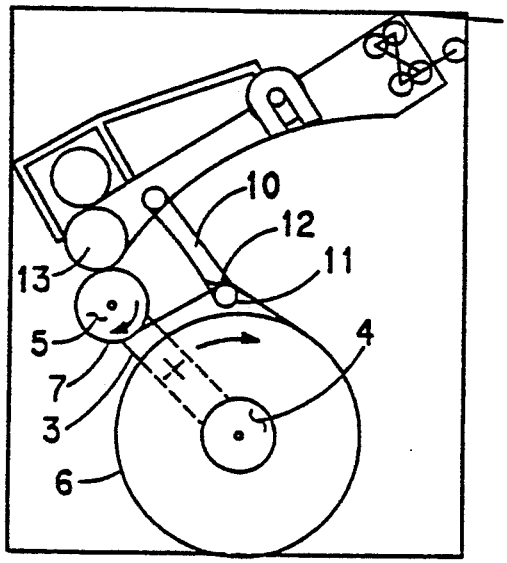
Figure 1H:
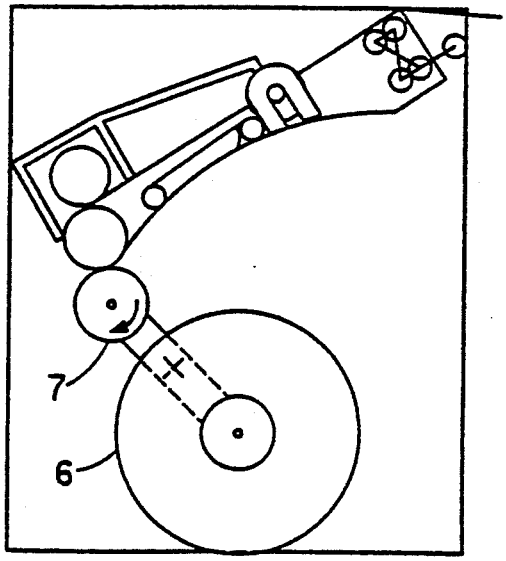
Figure 1J:
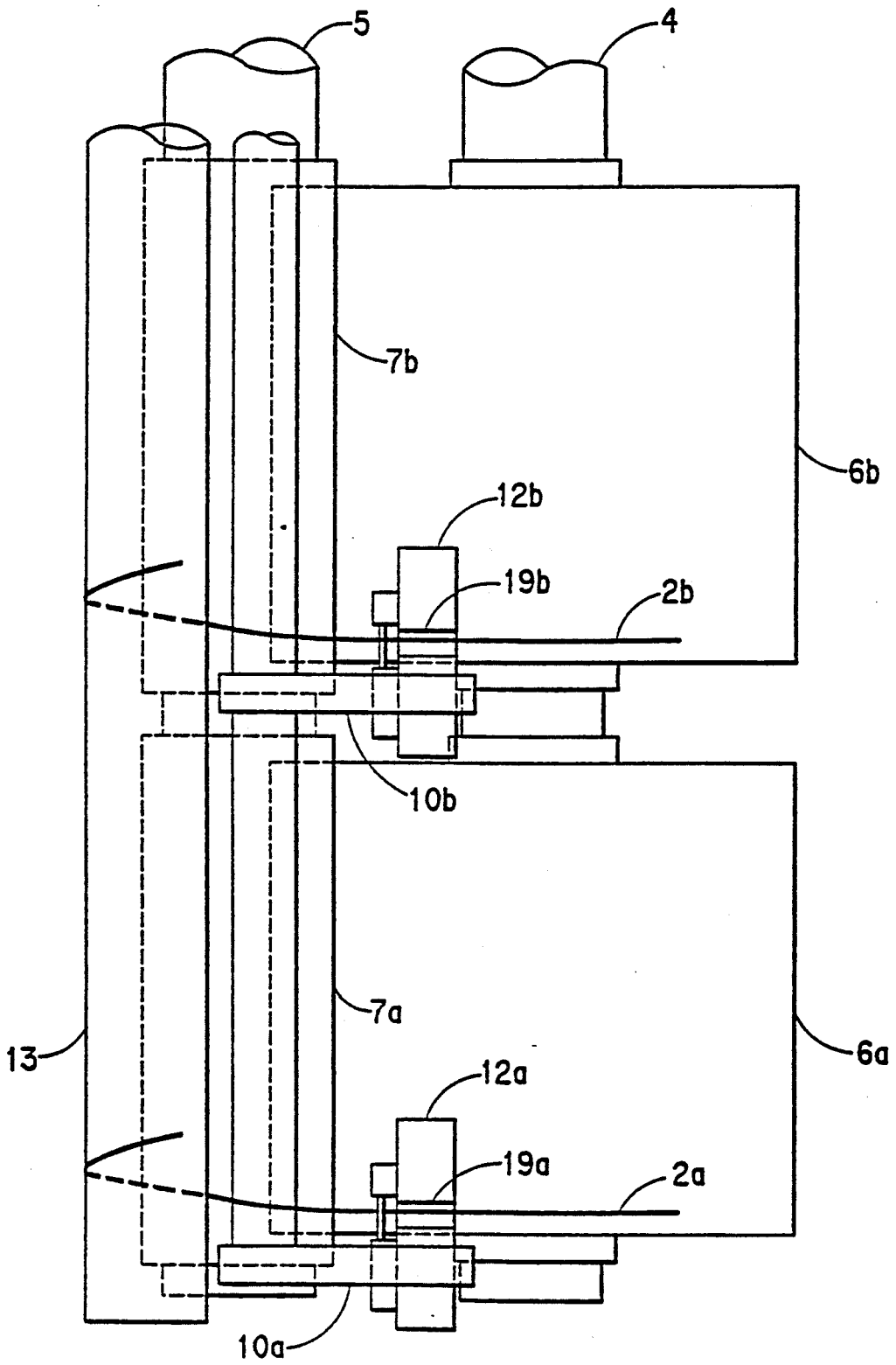
FIG. 1J is a top view of the winder shown in FIGS. 1F.

When the yarn package is at the desired diameter, the turret 3 moves full package 6 away and chuck 5 with empty tube core 7 is brought up to speed, as shown in FIG. 1B. At this point, the yarn is still being wound on full package 6. When the full package is clear as in FIG 1C, pivot arm 10 is dropped down and the bottom surface at end 11 may contact and deflect the traversing yarn line as shown. As traverse means 14 moves the yarn to the inboard side of the full package, the yarn goes past the end of the arms 10 and springs back to its normal path which is now above the end 11 and cutter 12, as shown in FIG. 1D. As turret 3 continues rotating the full package, the yarn approaches the cutter body. At this point, as shown in FIG. 1E, the yarn is disengaged from the traverse and engaged by a holding guide (not shown) to hold the yarn at the end of the core in line with a snagging device on chuck 5. As the yarn moves toward the cutter 12 due to turret rotation, it enters a slot in the body of each cutter 12 mounted on the arm. FIG. 1J shows yarns **2*a* and 2*b* in slots 19*a* and 19*b* just before snagging and the commencement of winding on cores 7*a* and 7*b*. In FIG. 1F, the empty tube core 7 is shown to be approaching bale roll 13** ready to begin winding yarn which is still being wound on full package 6. As chuck 5 reaches bale roll 13, snagging devices on chuck 5 (not shown) grab the yarn and start wrapping it on rotating empty tube core 7, as shown in FIG. 1G. This causes a yarn segment to wrap sharply over cutter 12 and build up yarn tension rapidly as the yarn is pulled in one direction by rotating chuck 5 and in an opposite direction by rotating chuck 4. At this point, the tensioned yarn actuates an air driven primary cutting mechanism in the cutter of this invention to cut the yarn.

After cutting, one end of the yarn is wound on the full package while the other end of the yarn is wound on the empty tube core, thus completing the automatic transfer from full package 6 to tube core 7. Package 6 is now removed from chuck 4 and replaced with an empty tube core ready for the next transfer while yarn is being wound on tube core 7, as shown in FIG. 1H.

Figure 2A:
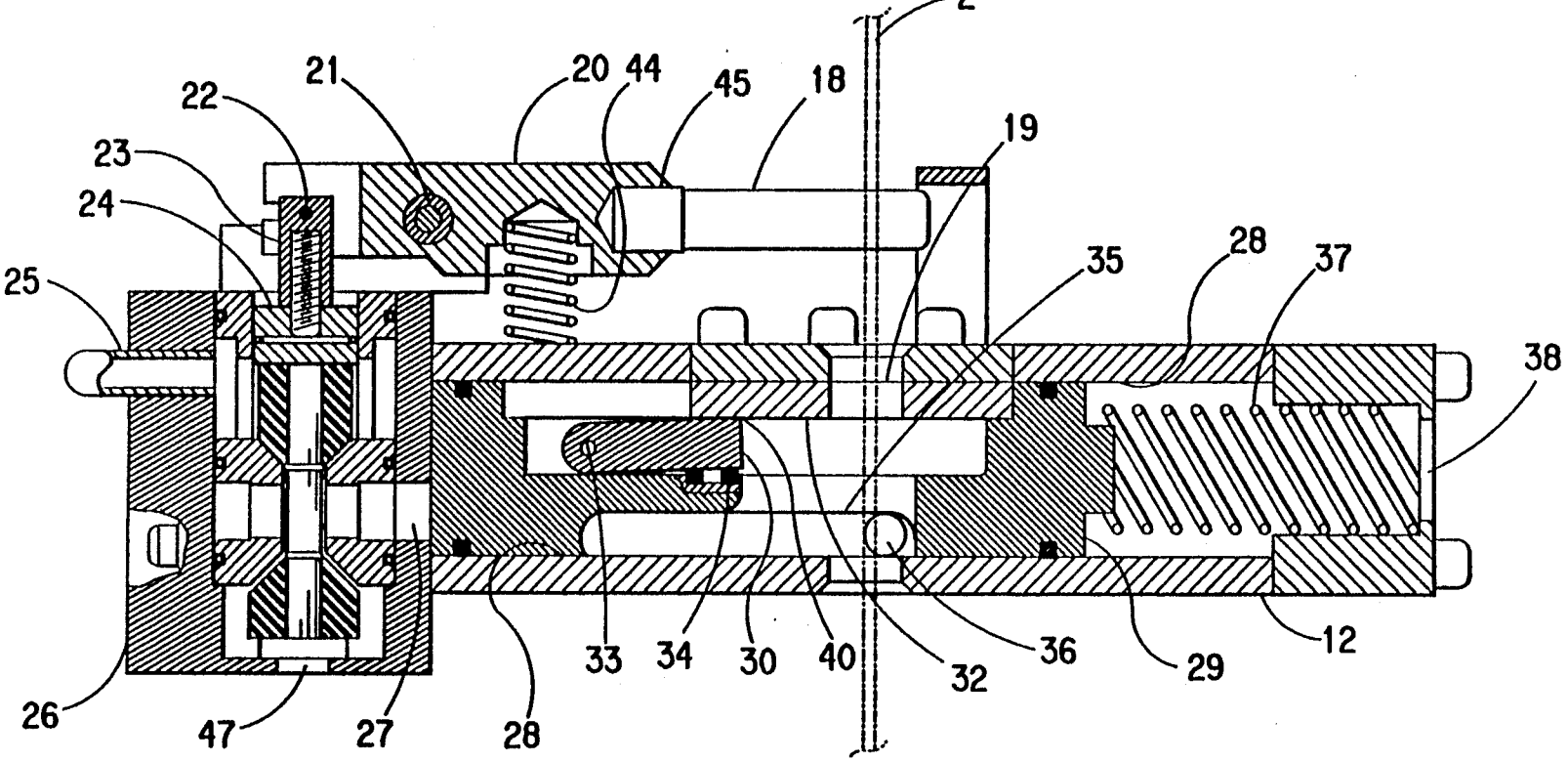
FIG. 2A is a sectional side view of the cutter of this invention with an actuating means, valve means, cylinder driving means and cutting means whereby the moveable cutting element is pivotable.
Figure 3:
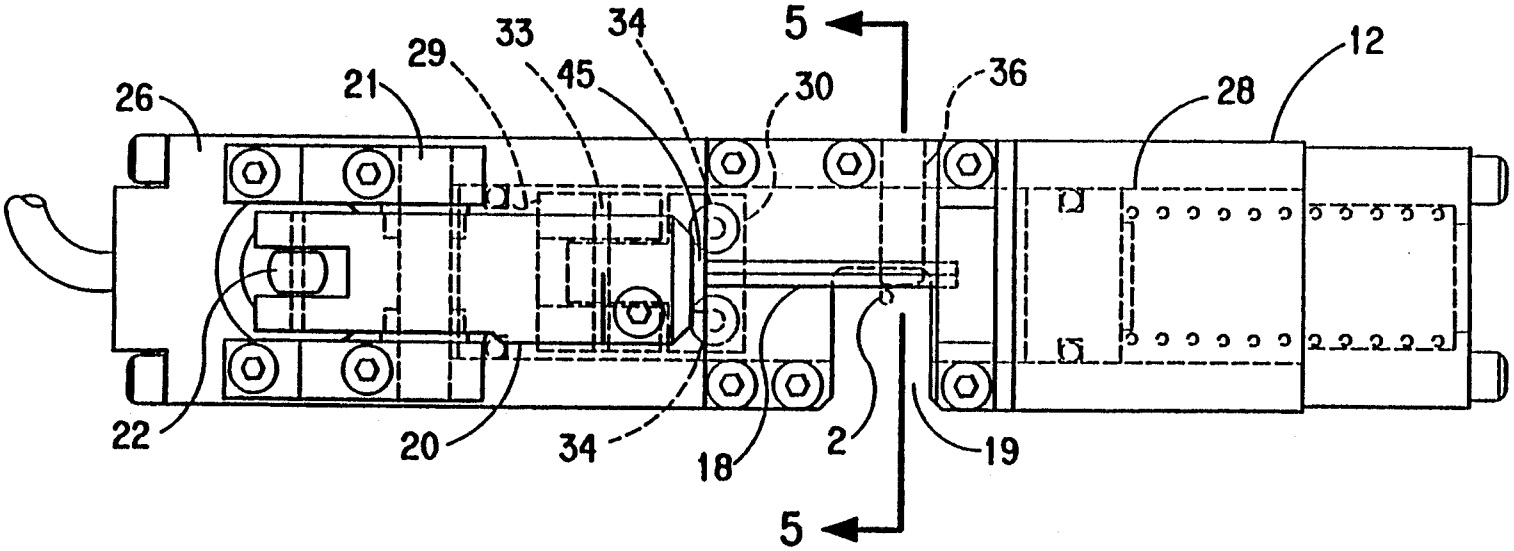
FIG. 3 is an overhead view of FIG. 2A.

FIGS. 2A AND 3 show one embodiment of the cutter featuring a cutter body 12 having a slot 19 extending transversely through a bore 28 in the body wherein a yarn strand 2 may be accepted; an actuator means pivotably affixed to the cutter body 12, the actuator means including a yarn contact surface 18 and a valve shifting means 22; a valve means attached to, or part of body 12 and including a shiftable element 24 connected to the actuator means, the element acting to alternatively direct a pressurized fluid from a source entering at port 25 to a first end of bore 28 through port 27 or from bore 28 to the atmosphere through port 47; a cutting means including a slotted piston 29 moveable by the fluid pressure directed into bore 28, the piston having a moveable cutting element 30 attached, which when moved by the piston is positioned to traverse slot 19 and pass by a stationary cutting edge on cutting element 32 fixed to body 12 at the side of the slot furthest from the first end of the bore, the cutting elements urged one against the other, thereby cutting any yarn received in the slot. By close coupling the actuator arm 45 and valve body 26 to the cutter body 12, the cutting means is very fast acting, reliable and simple in construction.

Figure 5:
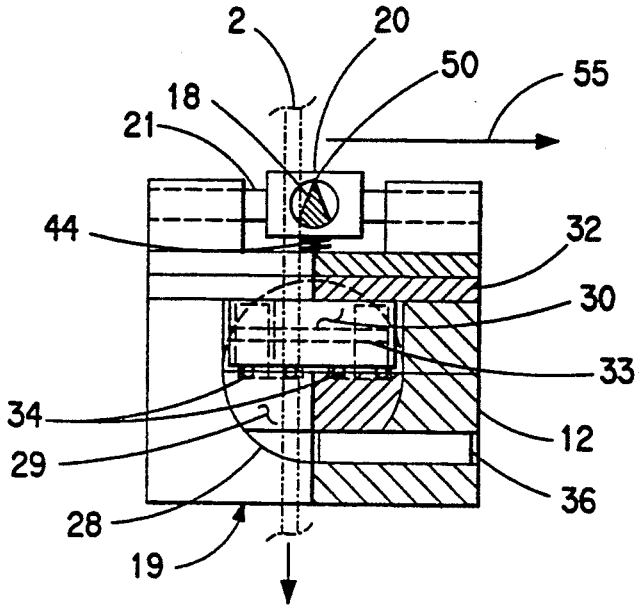
FIG. 5 is a sectional end view of the cutter of FIG. 3, shown by arrows 5—5.

The actuator means is attached to the body 12 by pivot pin 21 passing through clamp 20. The actuator includes an arm 45 having a yarn contact surface 18 which is shown in FIG. 5 with a sharp angled edge 50, with the arm held in clamp 20 pivotable about pivot 21, as shown in FIG. 2A. At the other end of the clamp from the arm, a valve pin 22 engages the end 23 of a shiftable element 24 which resembles a piston. Spring 44 pivotally urges clamp 20 and attached yarn contact surface 18 away from body 12 and urges shifting means 22 toward body 12, thereby forcing shiftable element 24 downward until it seals off the pressurized fluid from port 25. Referring to FIG. 5, when yarn 2 is pulled in the direction of arrow 55, there is a net force acting on surface 18 of arm 45 which compresses spring 44 and pivots clamp 20 and thereby raises shiftable element 24 (See also, FIG. 2A).

The valve means has valve body 26 supplied with pressurized air through port 25. Port 27 provides fluid communication between valve body 26 and cylinder bore 28 where the pressurized air acts on one end of slotted piston 29. Port 47 is an exhaust port from valve body 26 to direct pressurized air from bore 28 through port 27 to the atmosphere. As also, shown in FIG. 2A, when there is no yarn 2 under tension acting against surface 18, actuator arm 45 is not depressed and shiftable element 24 is in the closed position. As a result, pressurized air from port 25 is blocked from bore 28, exhaust port 47 is open, and no pressure acts on piston 29.

When yarn 2 is placed under tension acting against surface 18, actuator arm 45 is depressed, clamp 20 pivots to permit shiftable element 24 to open. When the shiftable element is open, fluid communication with port 47 is blocked and communication with port 25 is open allowing pressurized air to communicate through port 27 to bore 28. The pressurized air acts on piston 29 and attached cutting element 30 causing it to move rapidly and forcefully across cutting slot 19 where yarn 2 is passing under tension on the way to the winding package, thereby shearing the yarn against the cutting edge of stationary cutting element 32.

If the air driven primary cutting means fails, the sharp angled edge 50 on the actuator arm 45 may provide a back-up or secondary cutting capability so that cutting of light denier yarns is assured, but at a high tension.

The cutting means of FIGS. 2A, 3 and 5 comprise a piston 29 slideably fitted into the bore 28, a pivotable cutting element 30 mounted on the piston 29, and a fixed cutting element 32 mounted at the side of bore 28 with the cutting edge 42 (FIG. 2B) located at the side of the slot furthest from a first end of the bore where the pressurized fluid is admitted at port 27. A spring 37 between body 12 and piston 29, urges piston 29 against the first end of the bore. Moveable cutting element 30 is pivotably mounted to piston 29 at pivot point 33. Resilient biasing means 34 placed between the piston and moveable cutting element can consist of elastomeric "O rings" that uniformly direct moveable cutting element 30 away from piston 29 and holds it against the flat surface of stationary cutting element 32 which is rigidly attached to the housing of the cutting body. It has been determined that elastomeric O rings having a durometer of 85 are generally eligible for use in this invention. Larger denier yarns can use O rings of greater hardness and smaller denier may be able to use O rings of lower hardness. Piston 29 is closely guided in cylinder bore 28 and is prevented from rotating by the sliding contact of cutout 35 in the piston with an anti-rotational pin 36 in the cylinder bore 28. During the cutting stroke of the piston, spring "is compressed and air to the right of the piston is forced out of the cylinder bore 28 through opening 38.

For reliable cutting, it is desirable to achieve a line to surface contact between the edge of moveable cutting element 30 and the surface of stationary cutting element 32. This line to surface contact can occur by urging one cutting element against the other cutting element in a pivoting motion. The pivoting motion can be accomplished on either the stationary or the moveable cutting element. FIG. 2A shows an embodiment wherein the moveable cutting element is pivotable.

It is important that the cutting elements are closely guided so that a line to surface contact occurs continuously between the two cutting edges as they pass by each other to cut the yarn. It is also important that the cutting edges are urged together with uniform loading. The elastomeric O rings are preferred for such urging.

Figure 2B:
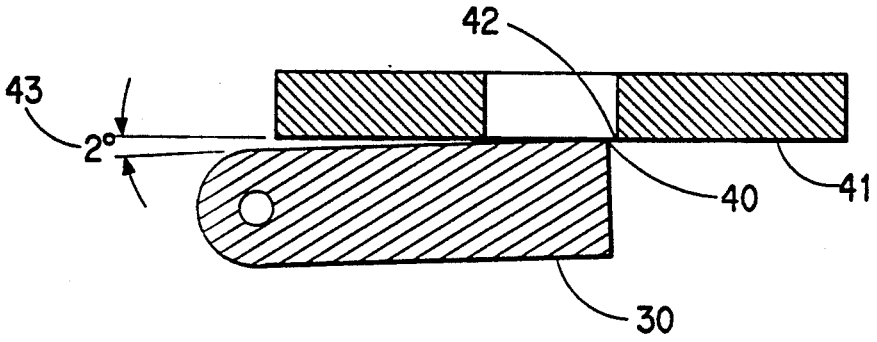
FIG. 2B is a sectional side view of the moveable cutting element in line to surface contact with the stationary cutting element.

FIG. 2B further shows this line to surface contact. In FIG. 2B, the contact between cutting edge 40 of moveable cutting element 30 and the surface 41 of stationary cutting element 32 is a line to surface contact. A line to surface contact is important in order that, as cutting edge 40 slides across cutting edge 42 of stationary cutting element 32, the yarn is cleanly cut. Any gaps or separation between the cutting edges would result in an incomplete and ragged cut. The line to surface contact is achieved by providing an angle of about two degrees at 43 between moveable cutting element 30 and stationary cutting element 32.

FIGS. 3 and 5 show an overhead view and section view, respectively, of FIG. 2A in which the resilient biasing means, consisting of two elastomeric O Rings 34, located between piston 29 and moveable cutting element 30, urges the moveable cutting element 30 away from piston 29 and towards stationary cutting element 32, thus insuring that the cutting edges are urged together with uniform loading. Close tolerancing of the cutting means parts and careful assembly, which may include shim spacing under the O rings to get the desired O ring compression, may be required to assure a significant load between the cutting elements.

It is important that the cutting elements are constructed of materials that will slide readily against one another and will withstand many cycles of reliable cutting. One material which is known to work well is C-2 grade tungsten carbide having a finish at the cutting edge that is finer than 20 microinches and is coated with chemical vapor deposition coatings of 2 microns of titanium carbide and further coated with 2 microns of titanium nitride. Another material which is known to work well is alumina ceramic, one version of which is called Aremcolox, grade 502-1400, furnished by Aremco Products, Inc. in Ossining, N.Y., USA. The alumina ceramic should also have a finish finer than 20 microinches. The same materials can be used for both cutting edges or different materials can be used for each edge. The combination of these materials with the line contact of the cutting elements and the resilient loading of the elements against one another produces surprisingly reliable long life cutting.

Referring again to FIG. 2A, after the yarn is cut, spring 44 moves clamp 20 up and shiftable element 24 is moved down. Moving the shiftable element down, opens vent port 47 and blocks supply port 25. Spring biasing means 37 acting on piston 29 returns the piston and moveable cutting element 30 to its original position, thereby clearing slot 19 for introduction of the next yarn to be cut.

Figure 4:
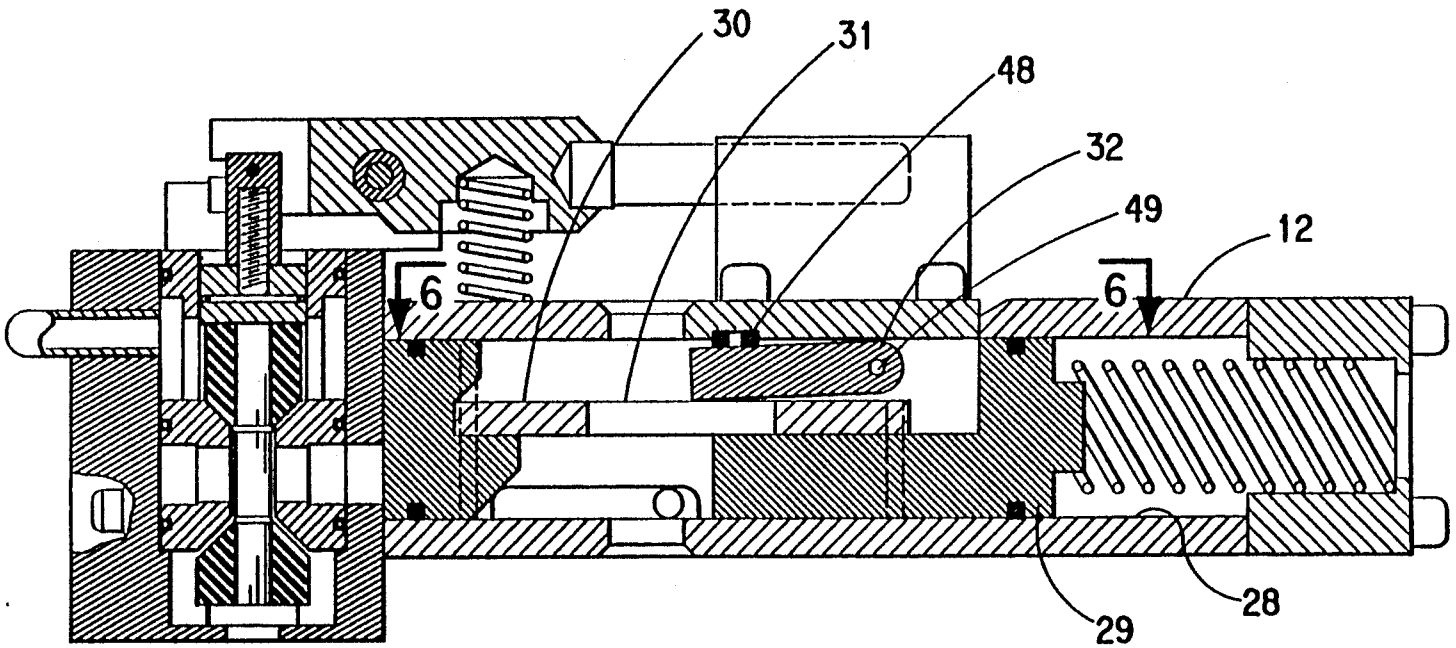
FIG. 4 is a sectional side view of the cutter of this invention with an actuating means, valve means, cylinder driving means and cutting means whereby the stationary cutting element is pivotable.
Figure 6:
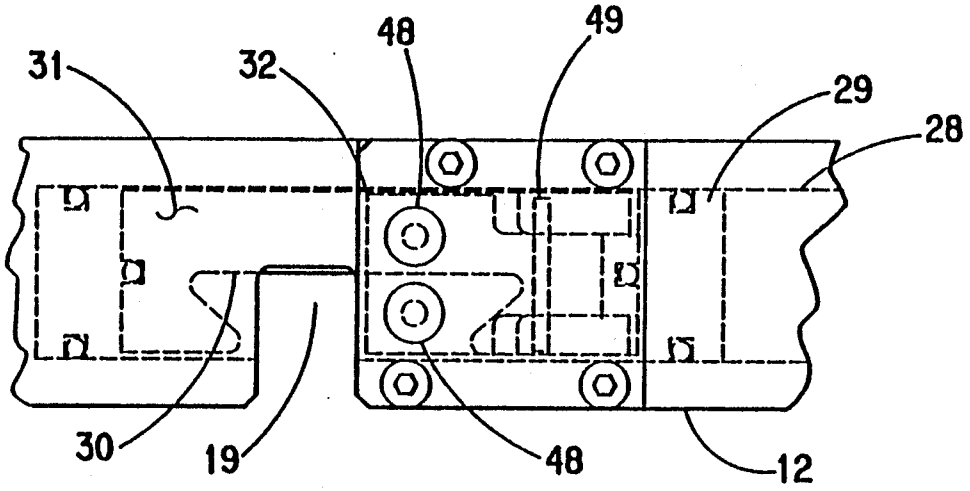
FIG. 6 is a partial overhead view of one embodiment of the cutter of this invention identified as view 6—6 in FIG. 4.

FIGS. 4 and 6 show an embodiment of the cutter of this invention in which stationary cutting element 32 is pivotable; and moveable cutting element 30 is part of a slotted bar 31 which is attached to piston 29. Stationary cutting element 32 is pivotably mounted to cutter body 12 at pivot 49. A resilient biasing means consisting of elastomeric O rings 48 urges stationary cutting element 32 away from cutter body 12 and holds it against moveable cutting element 30. The cutting element 30 of slotted bar 31 may be shaped in a way that guides the yarn into the cutting zone at the moment of cutting. This shaped cutting edge is an advantage if there is low tension on the yarn. The shape also provides a balanced contact of the elements on both sides of the yarn at the moment of cutting. Repetition of the shape at the opposite end of moveable cutting element 30 permits flipping the element to provide a fresh cutting edge.

In each embodiment of the cutter, the cutting of the yarn occurs very rapidly before any damaging tension is created. The high speed of the cut is a result of the direct connection between the actuator arm and the valve, the short distance the air must travel to the piston, and the relatively short distance the piston (with the attached moveable cutting element) must travel to cut the yarn. However, the piston moves a sufficient distance to allow the moveable cutting element to develop a high speed in order that it can rapidly cut the yarn against the stationary cutting element.

The cutter of the invention has been surprisingly effective in cutting aramid yarns with a wide range of deniers. For instance, for aramid yarns with deniers from about 200 to about 800, the tensioned yarn can be cut by the secondary cutter, that is, the sharp edge 18 of the actuator arm; for deniers of from about 800 to 7500, the tensioned yarn deflects the actuator arm and the primary cutter elements 30 and 32 cut the yarn. In one test with 3000 denier poly(p-phenylene terephthalamide) yarn winding at about 1000 yds/min, over 2000 cuts were made without failure. Such reliable long lasting cutting operation has not been obtained with other known shear cutters or with impact or grinding type cutters.

Figure 7:
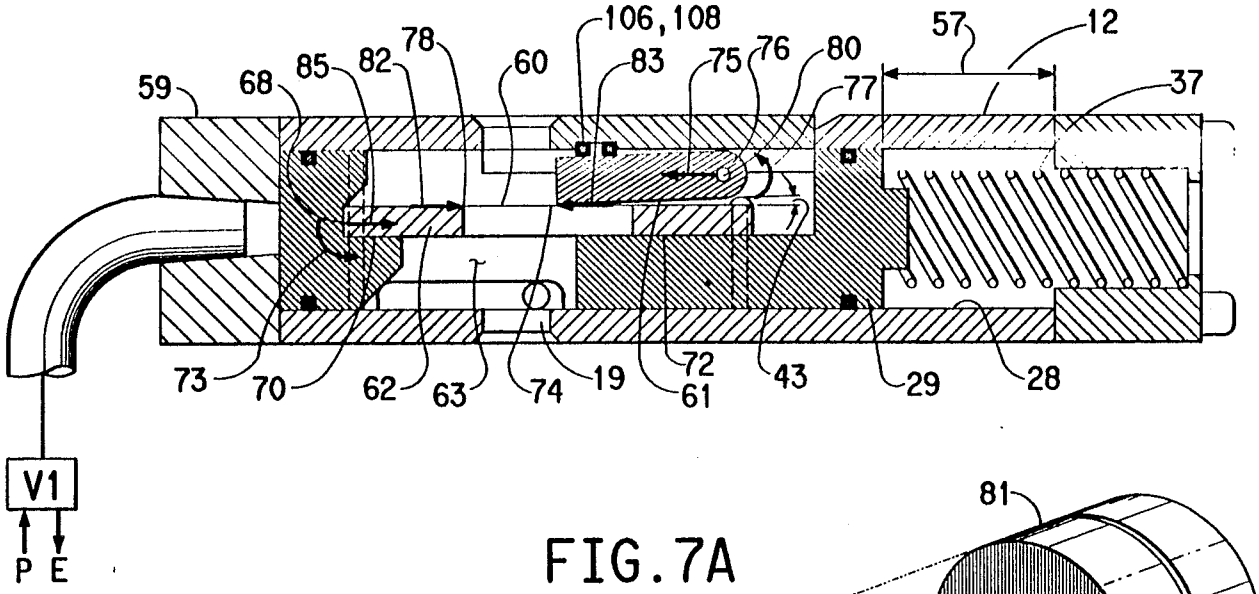
FIG. 7 is a sectional side view of the cutter of this invention, whereby a remote valve actuates the piston and a spring returns it, and the "line" cutting element is pivotally attached to the cutter body and resiliently urged against the "surface" cutting element.

The present invention also includes other cutter embodiments such as the one shown in FIG. 7 which does not have the tension sensor (actuator arm) or close coupled valve. Such a cutter is useful in those circumstances where the decision about when to cut the yarn is made by an operator, rather than by tension fluctuation in the running yarn. For example, in a winding operation where it is permissible for some yarn to go to waste between the winding of packages, or in a decoupled process where the winding or unwinding may be stopped before cutting, the operator can actuate the cutter at the desired time without having to coordinate the cut with a tension rise in the yarn. In this case, there is no need for the tension sensor and close coupled valve, rather the valve can be remotely located and actuated by the operator. It has been found that this basic cutter still offers several unique advantages in terms of cutting reliability and long wear over conventional cutting devices. This is particularly true with high strength yarns, such as poly(p-phenylene terephthalamide) aramid fibers, sold under the trademark "Kevlar" by E. I. du Pont de Nemours and Company, and large denier strands of "Kevlar" or polypropylene.

As pointed out in the previous discussion, the cutting element providing the "surface" in the "line-to-surface" contact between the cutting elements may be either the moveable or stationary element. Accordingly, the complementing cutter element providing the "line" may be either the moveable or stationary element, and the cutter will perform in the selected manner, as described above. In the following discussion, the cutting elements will be referred to as the "surface" and "line" elements, and they will be shown with the "surface" element as the moveable element and the "line" element as the stationary element, although these positions can be reversed.

It is believed that the following features of the basic cutter are responsible for its unique advantages:

the slotted body with a longitudinal bore therethrough, the slotted piston which provides stable support to the attached cutting element on both sides of the body slot and throughout the travel of the piston, the planar surface provided by the surface cutting element which a) is continuously parallel to the longitudinal axis of the bore, b) is supported on either side of the body slot, and c) is slotted to accommodate the body slot (This assures the positional relationship of the two cutting elements remains constant during the travel of one element relative to the other even as they cross the body slot.), and the rigid anti-rotation stop that continuously engages a surface on the piston and stops rotation of the piston throughout the piston travel. This anti-rotation device stops the piston's rotational direction which would separate the edge of the line element from the surface of the surface element at the side of the surface element which is opposite to the surface element's slot.

In addition, it is important that the supports for each cutting element are spaced away from the cutting plane, in order that the load imposed by each cutting edge on the other cutting edge during cutting creates a "pinching moment" about the opposing edge support. This pinching moment tends to enhance the contact between the line and surface elements of the line-to-surface contact, i.e., it creates a moment about the supports that tends to urge the cutting edges toward each other rather than away from each other during cutting.

Figure 7A:
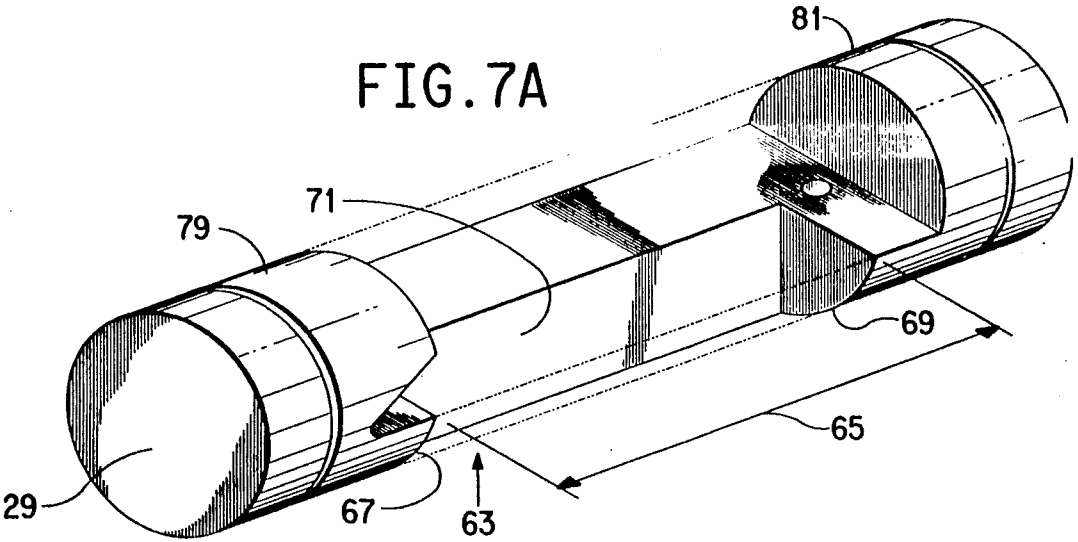
FIG. 7A is an isometric view of the piston in the cutter of FIG. 7.

Referring to FIGS. 7 and 7A, bore 28, containing slotted piston 29, is enclosed by end cap 59 which is alternately connected to a source of pressurized air "P" or an exhaust port "E" through valve "V1". The piston 29 has a slot 63 which has a width 65 which is greater than the body slot 19 plus the distance 57 the piston travels in the bore. The piston slot is positioned axially on the piston so that the edges of the slot at 67 and 69 remain outside the body slot during the piston travel so as not to interfere with the running yarn before or after the cut. The bottom 71 of the piston slot is aligned with the bottom 56 (FIG. 6) of the body slot. The piston 29 has portions 79 and 81 that are located on either side of slot 63, which when assembled in bore 28 fall on either side of body slot 19. These portions in slideable engagement with the bore provide stable support of the piston and attached cutting element on both sides of the body slot. This is important to provide stable alignment between the cutting elements during the travel of the piston.

The surface 60 on surface element 62 is continuously parallel to the longitudinal axis of bore 28. This assures that the angle 43 and relative position between the surface 60 and the surface 61 adjacent to straight line cutting edge 74 remains constant and does not change during the travel of the piston and cutting of the yarn.

Surface cutting element 62 with surface 60 spans the body slot 19 and is supported on piston 29 at point 70 on the left of the slot and point 72 on the right of the slot. This assures an accurate vertical position of the surface relative to cutting edge 74 on line element 76 during the complete travel of the moveable surface cutting element in operation.

The cutting edge 78 of surface element 62 is on the cutting plane defined by surface 60. This cutting edge is supported behind and below the edge at 70 and 68; the line of force exerted by the support acts along vector 85 which is spaced below cutting surface 60. The cutting edge 74 of line element 76 is pivotally affixed at pivot 80 which is spaced above cutting surface 60; the line of force exerted by this support acts along vector 75. During cutting, an action force 82 is developed at edge 78 and an action force 83 is developed at edge 74 as the cutting edges move toward each other and encounter the yarn between them. The moment 73 about support 70 from action force 83, and the moment 77 about support 80 from action force 82 tend to force the cutting edges toward each other; these type of moments are referred to as "pinching moments". These pinching moments decrease the possibility of cutter separation and improve the reliability of the cutter.

Figure 8:
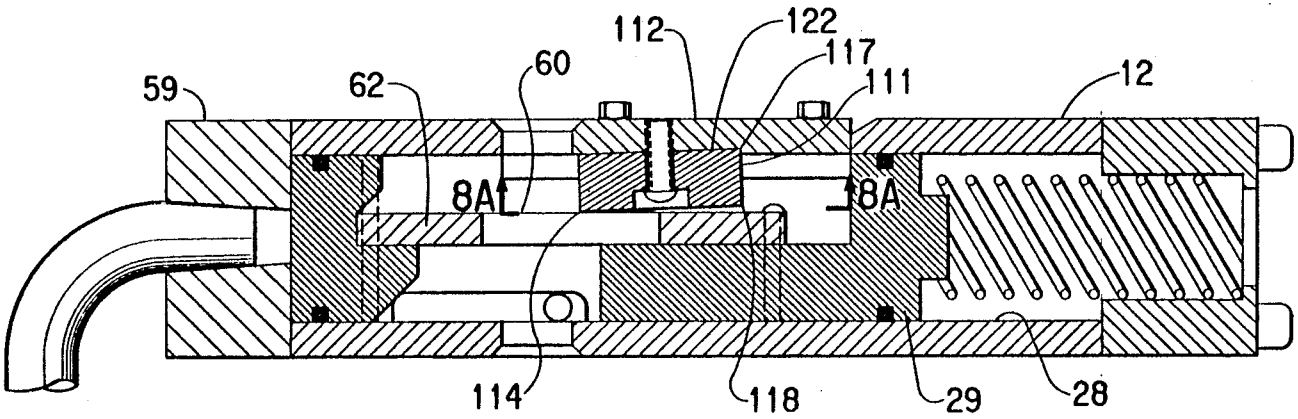
FIG. 8 is a sectional side view of the cutter of this invention, whereby a remote valve actuates the piston and a spring returns it and the "line" cutting element is rigidly attached to the cutter body.
Figure 8A:
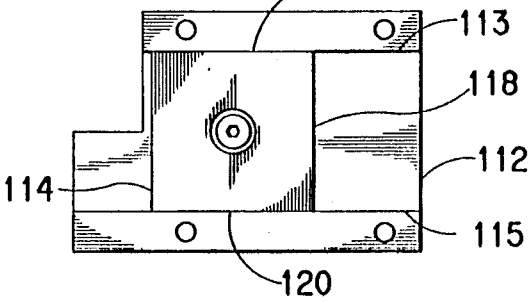
FIG. 8A is view A—A from FIG. 8 showing the "line" element rigidly attached to the housing.

FIGS. 8 and 8A show another cutter embodiment where the pivot 80 and resilient members 106 and 108 have been eliminated and line cutting element 111 is rigidly affixed to plate 112 which is fastened to housing 12. Line element 111 is angled with respect to surface 60 of moveable surface cutting element 62 to retain the line-to-surface contact. Line element 111 is preferably a square shape with cutting edges on all four lower edges 114, 116, 11 8, and 120. Line element 111 fits closely between parallel sides 113 and 115 on plate 112 and is positioned by shoulder 117 which absorbs the cutting force on edge 114. The square shape permits rotating of line element 111 by 90 degrees to obtain a new cutting edge quickly with minimum downtime and effort. In addition, line element 111 can have shims placed at 122 between it and plate 112 to adjust it relative to cutting surface 60, in order that cutting edge 114 rides close to surface 60 with little or no clearance. A condition of no clearance is possible without binding, because there is a small working clearance between piston 29 and bore 28 that will accommodate minor inaccuracies. There must not be a clearance between edge 114 and surface 60 larger than the diameter of a single filament in the yarn strand being cut. For very small high strength strands, the resiliently biased pivoted cutting element of FIGS. 7 and 9A–9C is preferred.

Figure 9A:
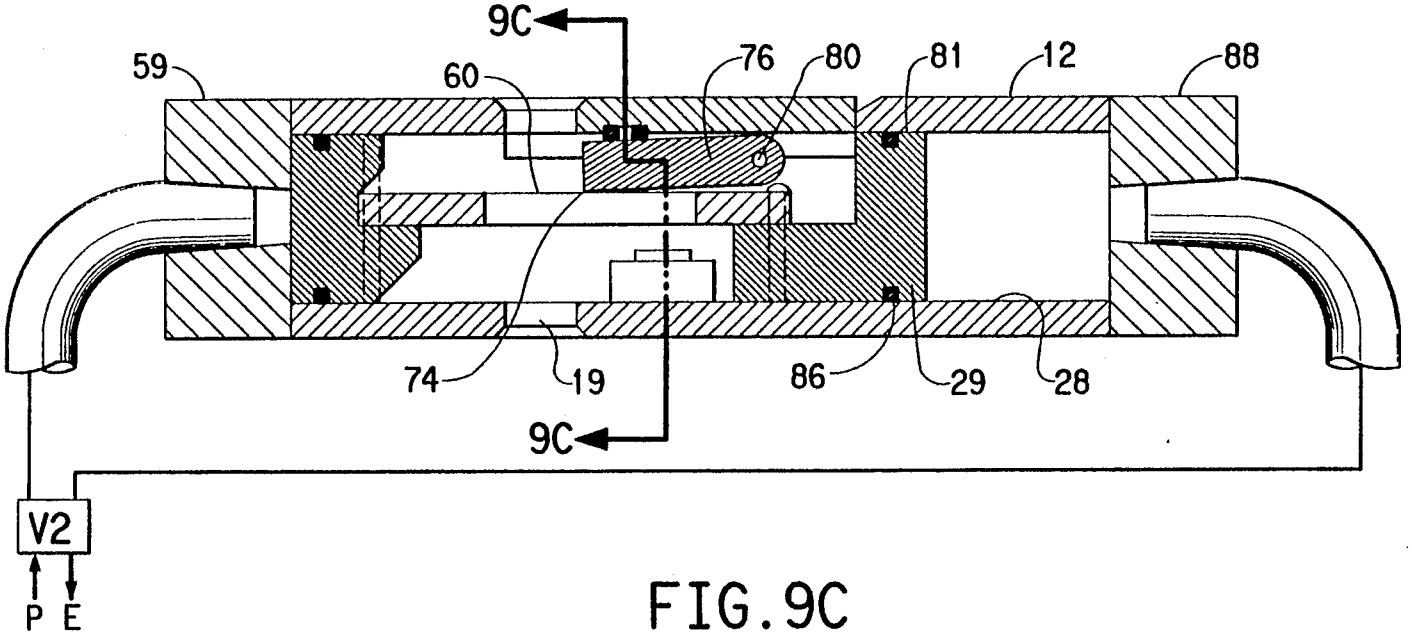
FIG. 9A is a sectional side view of the cutter of this invention, whereby a remote valve actuates the piston and also returns it, and an alternate anti-rotation device is shown.
Figure 9C:
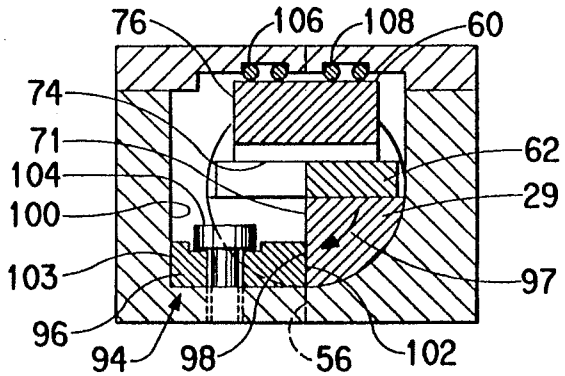
FIG. 9C is view C—C from FIG. 9A showing an alternate anti-rotation device.
Figure 9B:
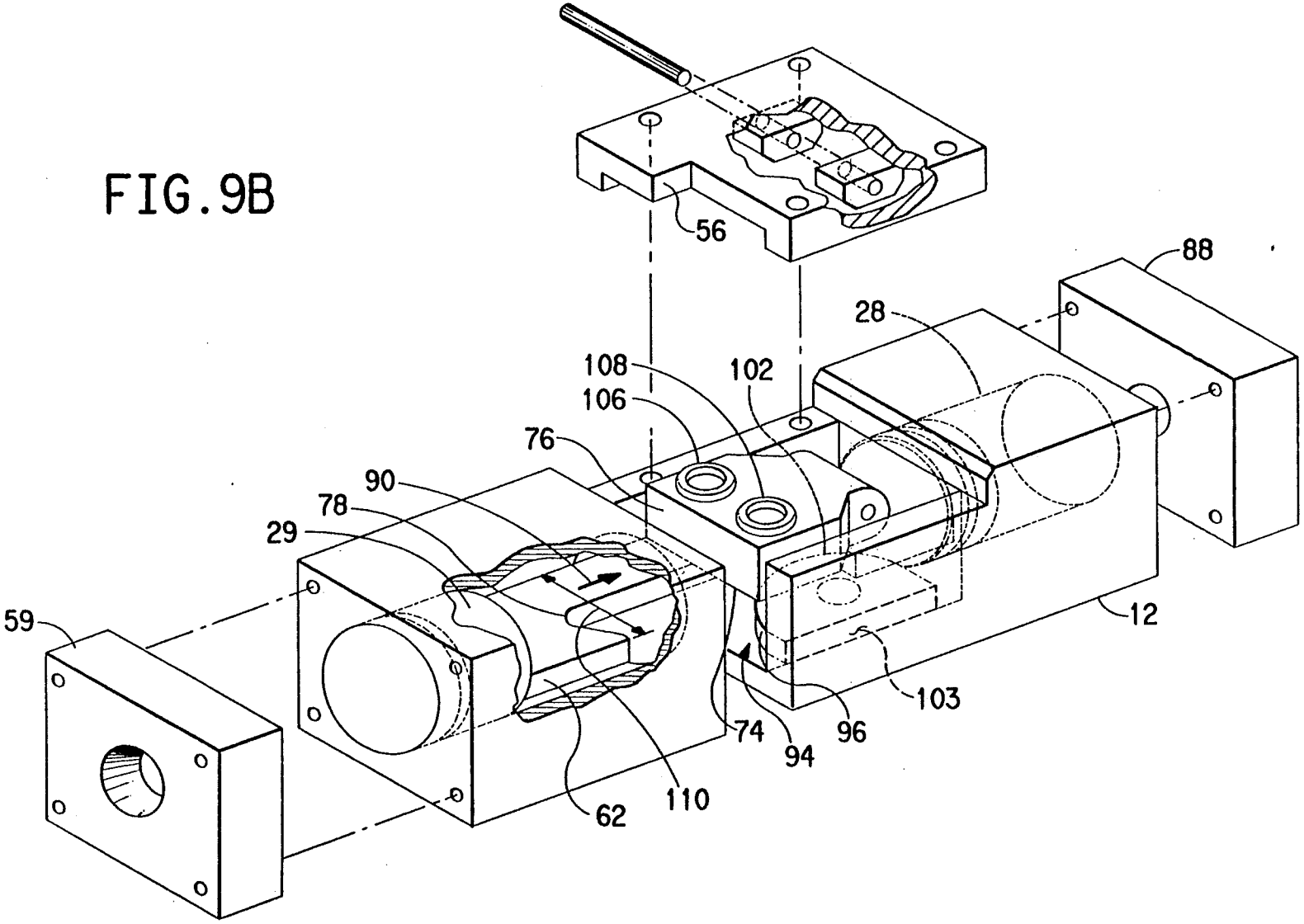
FIG. 9B is an exploded, overhead view of the cutter of FIG. 9A.

FIGS. 9A, 9B, and 9C show another embodiment of the cutter where the return spring, such as 37 in FIG. 7, for piston element 29 has been omitted and a seal 86 is used to form a return piston on portion 81 of piston element 29. End cap 59 encloses the left end of bore 28, and end cap 88 encloses the right end. End caps 59 and 88 are alternately connected to a source of pressurized air "P" or an exhaust port "E" through valve "V2". This has the beneficial effect of speeding up the operation of the cutting stroke since the piston does not have to overcome the force of the spring when moving in the cutting direction indicated by arrow 90 in FIG. 9B.

Also, FIGS. 9A, 9B, and 9C best illustrate an alternate anti-rotation device for piston element 29. Housing 12 has a cutout at 94 that makes room for block 96. When cutting surface 60 is oriented parallel to cutting edge 74 of line element 76 as best seen in FIG. 9C, block 96 is made to fit between surface 98 on piston 29 and surface 100 of cutout 94. Block 96 is preferably curved as at 102 where it contacts surface 98, and flat as at 103 where it contacts surface 100, such that in use, there is little tendency for block 96 to rotate about fastener 104 which fastens the block to housing 12. Block 96 is a rigid member that prevents clockwise rotation 97 (FIG. 9C) of piston 29 due to uneven preload of resilient members 106 and 108 acting through line cutting element 76 on surface cutting element 62. This condition exists during most of the travel of surface element 62. Near the end of the stroke of surface element 62 when the strand is being cut, line element 76 contacts the full width 110 of surface element 62, so that such unbalance does not exist and any tendency for counterclockwise rotation is resisted by the even preload of members 106 and 108.

Alternate anti-rotation devices that rigidly engage a surface on the piston and a surface on the body throughout the travel of the piston are also possible. For example, a pin could be radially inserted in the piston intermediate the piston portions 79 and 81 (FIG. 7A) and their seals. The pin could pass through a longitudinal slot cut in a continuous side of the body, whereby an edge or edges of the body slot would contact the pin and prevent piston rotation.

I claim:

1. A yarn cutter, comprising:

a) a cutter body containing a bore therethrough with a body notch extending transversely from one side of the cutter body through the bore to a notch bottom, the body notch adapted to receive a yarn;

b) a cutting means for cutting the yarn received in the body notch, comprising:

i) a piston slideably fitted into the bore and adapted to move from a first end of the bore to a second end, the piston having a notch extending transversely from one side of the piston to a notch bottom which is aligned with the bottom of the body notch, ii) a cutting element having a notch therein, the cutting element affixed to the cutter body, having a planar surface and a cutting edge at one side of the element notch, the edge positioned adjacent to a side of the body notch opposite the first end of the bore, wherein the surface is continuously parallel to the longitudinal axis of the bore, extends from one side of the body notch to the other, and is supported on both sides of the body notch, and iii) a cutting element affixed to the piston, having a straight line cutting edge that is in contact with the surface of the notched cutting element, thereby creating a line-to-surface contact between the cutting elements through the piston travel from the first end to the second end of the bore; and c) a rigid stop means continuously engaging a surface on the cutter body and a surface on the piston throughout the piston travel, thereby preventing rotation of the piston.

2. A yarn cutter, comprising:

a) a cutter body containing a bore therethrough with a body notch extending transversely from one side of the cutter body through the bore to a notch bottom, the body notch adapted to receive a yarn;

b) a cutting means for cutting the yarn received in the body notch, comprising:

i) a piston slideably fitted into the bore and adapted to move from a first end of the bore to a second end, the piston having a notch extending transversely from one side of the piston to a notch bottom, which is aligned with the bottom of the body notch, ii) a cutting element having a notch, the cutting element affixed to the piston, having a planar surface and a cutting edge at one side of the element notch, the edge positioned adjacent to a side of the piston notch adjacent to the first end of the bore, wherein the surface is continuously parallel to the longitudinal axis of the bore, extends from one side of the piston notch to the other, and is supported on both side of the piston notch, and iii) a cutting element affixed to the cutter body, having a straight line cutting edge that is in contact with the surface of the notched cutting element, thereby creating a line-to-surface contact between the cutting elements throughout the piston travel from the first end to the second end of the bore; and c) a rigid stop means continuously engaging a surface on the cutter body and a surface on the piston throughout the piston travel, thereby preventing rotation of the piston.

3. The yarn cutter of claim 1 or 2, further comprising a means for directing a source of pressurized fluid from a source to the first end of the bore, thereby forcing the piston to travel from the first end to the second end of the bore and passing the edge of the cutting element attached to the piston past the edge of the cutting element attached to the cutter body, thereby cutting the yarn.

4. The yarn cutter of claim 3, further comprising a spring biasing means affixed to the cutter body at the second end of the bore, for urging the piston against the force of the pressurized fluid.

5. The yarn cutter of claim 3, further comprising a means for alternately directing the pressurized fluid from the source to the second end of the bore, thereby forcing the piston to travel from the second end to the first end of the bore.

6. The yarn cutter of claim 1 or 2, further comprising a resilient biasing means for urging the straight line cutting edge against the planar surface of the notched cutting element.

7. The yarn cutter of claim 6, wherein the resilient biasing means comprises an elastomer.

8. The yarn cutter of claim 7, wherein the elastomeric biasing means is in the form of a pair of O-rings.

9. The yarn cutter of claim 1 or 2, wherein the support for each cutting element is spaced away from the planar surface of the notched cutting element, such that a pinching moment about each support is created as the cutting edges come together to cut the yarn.

10. The yarn cutter of claim 1, wherein the cutting elements are made from alumina ceramic.

11. The yarn cutter of claim 1, wherein the cutting elements are made from tungsten carbide and coated first with titanium carbide and then with titanium nitride.

12. The yarn cutter of claim 1, wherein one of the cutting elements is made from tungsten carbide and coated first with titanium carbide and then with titanium nitride, and the other outting element is made from alumina ceramic.

* * * * *

UNITED STATES PATENT AND TRADEMARK OFFICE

CERTIFICATE OF CORRECTION

PATENT NO. : 5,150,640

DATED : SEPTEMBER 29, 1992

INVENTOR(S) : TADEUSZ E. SCHNITZER

It is certified that error appears in the above-identified patent and that said Letters Patent is hereby corrected as shown below:

COLUMN 11, LINE 31, "THROUGH" SHOULD BE "THROUGHOUT".

COLUMN 12, LINE 55, "OUTTING" SHOULD BE "CUTTING".

Signed and Sealed this

Fourteenth Day of September, 1993

Bruce Lehman

*Attest:*

BRUCE LEHMAN

*Attesting Officer*

*Commissioner of Patents and Trademarks*